US008298075B2

(12) United States Patent
Tishler

(10) Patent No.: US 8,298,075 B2
(45) Date of Patent: Oct. 30, 2012

(54) CASINO POKER GAME WITH OPTIONAL CARD

(76) Inventor: Kevin Tishler, Long Beach, CA (US)

( * ) Notice: Subject to any disclaimer, the term of this patent is extended or adjusted under 35 U.S.C. 154(b) by 749 days.

(21) Appl. No.: 12/474,233

(22) Filed: May 28, 2009

(65) Prior Publication Data

US 2009/0298565 A1 Dec. 3, 2009

Related U.S. Application Data

(60) Provisional application No. 61/056,692, filed on May 28, 2008.

(51) Int. Cl.
*A63F 9/24* (2006.01)

(52) U.S. Cl. ..... 463/25

(58) Field of Classification Search ..... 463/12, 463/13, 25

See application file for complete search history.

(56) References Cited

U.S. PATENT DOCUMENTS

| | | | | |
|---|---|---|---|---|
| 2005/0082758 | A1 | 4/2005 | Sklansky et al. | |
| 2006/0066050 | A1 | 3/2006 | Sorge | |
| 2006/0244216 | A1 | 11/2006 | O'Hagan | |
| 2007/0057465 | A1 | 3/2007 | Dargue | |
| 2007/0194532 | A1 | 8/2007 | Skistimas | |
| 2007/0205558 | A1 * | 9/2007 | Hohman | 273/292 |
| 2007/0228653 | A1 | 10/2007 | Lambert | |
| 2007/0262524 | A1 * | 11/2007 | Lambert | 273/292 |

* cited by examiner

*Primary Examiner* — Bradley K Smith
(74) *Attorney, Agent, or Firm* — Muskin & Cusick LLC

(57) ABSTRACT

A method, system, and computer readable storage medium to provide a variation of a casino poker game that combines games of blackjack and poker into a single game. An optional card is available for use by the player in both the blackjack game and the poker game, but in order to use the optional card the player must make an additional wager.

20 Claims, 3 Drawing Sheets

CASINO POKER GAME WITH OPTIONAL CARD

CROSS REFERENCE TO RELATED APPLICATIONS

This application claims benefit to provisional application 61/056,692, filed May 28, 2008, which is incorporated by reference herein in its entirety.

BACKGROUND OF THE INVENTION

1. Field of the Invention

The present inventive concept relates to a system, method, and computer readable storage, for playing a variation of a casino poker game.

2. Description of the Related Art

Casino poker games are known in the art. What is needed is a new variation of casino poker game that can create additional excitement for players

SUMMARY OF THE INVENTION

It is an aspect of the present general inventive concept to provide an exciting wagering game.

The above aspects can also be obtained by a method that includes (a) providing a physical deck(s) of cards; (b) receiving a blackjack ante wager from a player and a poker ante wager; (c) dealing player's cards, dealer's cards, an optional card, and community cards; (d) offering the player an option to make an additional wager to discard one of the player's cards and activate the optional card and receiving the player's acceptance or denial of the option; (e) determining the player's blackjack hand using the player's card(s) and the optional card if activated; (f) determining the players poker hand using the player's card(s), the community cards, and the optional card if activated; (g) determining the dealer's blackjack hand and the dealer's poker hand; (h) resolving the blackjack ante wager based on a relationship between the player's blackjack hand and the dealer's blackjack hand; and (i) resolving the poker ante wager based on a relationship between the player's poker hand and the dealer's poker hand.

The above aspects can also be obtained by a method that includes (a) providing a physical deck(s) of cards; (b) dealing player's cards, dealer's cards, an optional card, and community cards; (c) determining the player's blackjack hand using the player's cards; (d) determining the players poker hand using the player's cards and the community cards; (e) determining the dealer's blackjack hand using the dealer's cards and the dealer's poker hand using the dealer's cards; and (f) resolving a first wager placed by a player, wherein if both the player's blackjack hand beats the dealer's blackjack hand and if the player's poker hand beats the dealer's poker hand then the player wins a payout on the first wager, otherwise the player does not win a payout on the first wager.

The above aspects can also be obtained by an apparatus that includes (a) a processing unit, performing: (b) providing a virtual deck(s) of cards; (c) receiving a blackjack ante wager from a player and a poker ante wager; (d) dealing player's cards, dealer's cards, an optional card, and community cards; (e) offering the player an option to make an additional wager to discard one of the player's cards and activate the optional card and receiving the player's acceptance or denial of the option; (f) determining the player's blackjack hand using the player's card(s) and the optional card if activated; (g) determining the players poker hand using the player's card(s), the community cards, and the optional card if activated; (h) determining the dealer's blackjack hand and the dealer's poker hand; (i) resolving the blackjack ante wager based on a relationship between the player's blackjack hand and the dealer's blackjack hand; (j) resolving the poker ante wager based on a relationship between the player's poker hand and the dealer's poker hand; and (k) an output device outputting results of the dealing and resolving.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
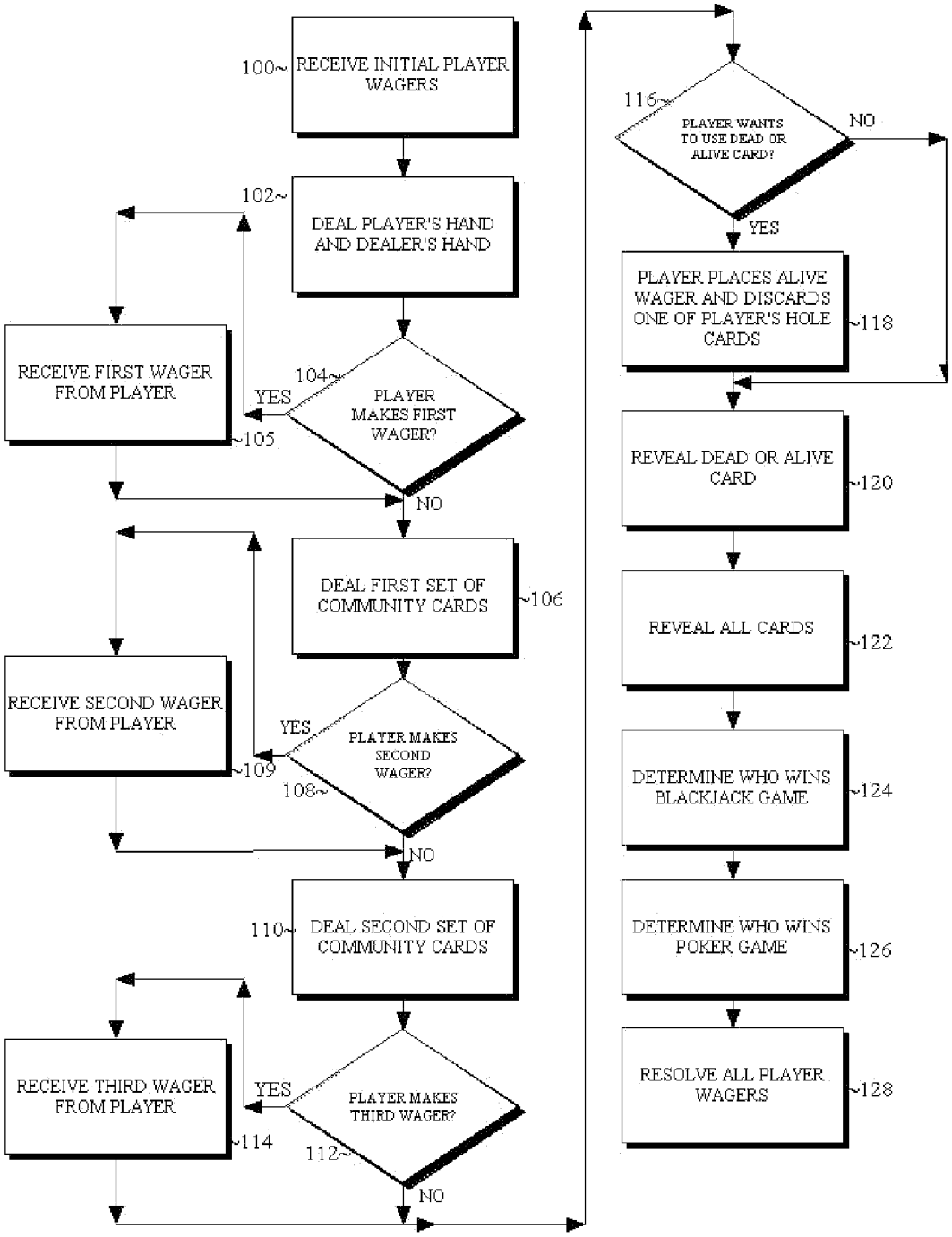
FIG. 1 is a flowchart illustrating an exemplary method of implementing a poker game, according to an embodiment.

Reference will now be made in detail to the presently preferred embodiments of the invention, examples of which are illustrated in the accompanying drawings, wherein like reference numerals refer to like elements throughout.

The general inventive concept relates to a casino game putting a player (or a plurality of players) against a dealer in a game which combines elements of blackjack and poker. Each player makes initial wagers, and throughout the course of the game, additional cards are revealed and each player has the opportunity to place or decline to place additional wagers using whatever cards have been revealed as information to base their decisions on.

When all cards are dealt and revealed, then a player's blackjack hand is formed using a subset of the dealt cards and a dealer's blackjack hand is formed using a subset of the dealt cards. A player's poker hand is formed using a subset of the dealt cards and a dealer's poker hand is formed using a subset of the dealt cards. The cards available to form the player's poker hand (based on predetermined rules) are not identical to the cards available to form the dealer's poker hand (based on predetermined rules). The cards available to form the player's blackjack hand (based on predetermined rules) are not identical to the cards available to the cards available to form the dealer's blackjack hand (based on predetermined rules).

The wagers placed by the player before or during the game are then resolved based on who wins the blackjack game (pitting the player's blackjack hand against the dealer's blackjack hand) and who wins the poker game (pitting the player's poker hand against the dealer's poker hand). A combined wager can also be based on requiring the player to win both the blackjack game and the poker game, otherwise the player does not win the combined wager.

FIG. 1 is a flowchart illustrating an exemplary method of implementing a poker game, according to an embodiment.

The method begins with operation 100, which receives initial player wagers. The player places two ante wagers, a poker ante wager and a blackjack ante wager. The poker ante wager is resolved based on a player's poker hand compared to a dealer's poker hand. The blackjack ante wager is resolved based on a player blackjack hand compared to a dealer's blackjack hand. These bets are both mandatory, although in a further embodiment either or both can be optional. The poker ante wager and the blackjack ante wager must be equal in value, although in an alternate embodiment this is not required.

In operation 100 the player can also place an optional progressive jackpot wager. Typically, this bet will cost $1 and will feed a progressive meter.

From operation 100, the method proceeds to operation 102, wherein the dealer deals both a player's hand and a dealer's hand. In one embodiment, the player's hand is two hole cards dealt face down (but each player is allowed to view their respective cards). The dealer's hand (dealer's initial cards) is one card dealt face up (upcard) and two cards dealt face down (2 hole cards). In further embodiments, different numbers of cards can be dealt for the player's hand and the dealer's hand, and different subsets of each hand can be dealt face up or face down depending on the house rules.

From operation 102 the method proceeds to operation 104 which determines whether the player makes a first wager (wager #1). The first wager is an optional wager that the player can decide to make after viewing his or her own hole cards and the card dealt face up to the dealer. The first wager is won by the player if the player wins both the blackjack hand and the poker hand. If the player wishes to make the first wager, then the method proceeds to operation 105, wherein the player places chips on a first wager betting circle and the first wager must be equal to the value of the ante bets. In an alternate embodiment, the first wager amount does not have to be equal to the value of the ante bets and can be less or more. If the player does not wish to place the first wager then he or she does not have to do so and the method continues to operation 106.

From either operation 104 or 105, the method continues to operation 106 which deals a first set of community cards. The first set of community cards are a face down card (the "dead or alive" also known as an "optional" card) and two community cards dealt face up. In other embodiments, different numbers of community cards can be used. The dead or alive card (as with the dealer's face down hole cards) will be revealed at a later point in the game.

From operation 106, the method proceeds to operation 108 which determines whether the player makes a second wager (wager #2). The second wager is optional at the decision of the player, wherein the player would of course consider all of the cards viewable by him or her before he or she makes this decision. The second wager is resolved based on the poker hand. If the player decides to make the second wager, then the method proceeds to operation 109, wherein the casino receives the second wager from the player. The second wager must be equal to the value of the ante wagers, although in an alternate embodiment this is not required. To make the second wager, the player would place his or her chips in a second wager betting circle.

From either operation 109 or 108, the method continues to operation 110, wherein the dealer deals out a second set of community cards. The second set of community cards are two cards dealt face up, although in alternate embodiments other amounts of cards can be used.

From operation 110, the method proceeds to operation 112, which determines whether the player decides to make a third wager (wager #3). The third wager is based on the poker hand and must be equal to the ante wagers, although in an alternate embodiment it is not required to be equal to the ante wagers. If the player wishes to place the third wager the method can proceed to operation 114 wherein the player places the third wager.

From either operation 112 or 114, the method proceeds to operation 116, wherein the player decides whether to use the "dead or alive" (or "optional") card. In order to use the optional card the player must place an additional wager (the "alive" wager). The optional card is still face down at this point and thus the player does not know its value. If the player wishes to use the optional card (to improve both his or her blackjack hand and poker hand) then the player can indicate this decision to the dealer and the method would proceed to operation 118.

In operation 118, the player places an "alive" wager in an alive betting circle and also discards one of the player's hole cards by physically moving the hole card to be discarded towards the dealer (or some other physical or verbal signal). Of course the player is hoping that when the optional card is revealed it will be a card that will help the player (both for the player's blackjack hand as well as the player's poker hand). The player will be effectively trading in the discarded hole card for the optional card. The alive wager must be equal in value to the ante wager. The discarded card can no longer be used in the game (either by the player or by the dealer), however by placing the alive wager the player has "activated" (for the particular player only, each player has to make their own respective alive wager to activate the card for themselves) the "dead or alive" card and this card can now be used to improve the player's blackjack and the player's poker hand. If the player did not make the alive wager, then the dead or alive card is not activated and cannot be used by the player.

It is noted that all players playing at the table will be given the chance to make the alive wager before the method proceeds to reveal the optional card. Thus, no player will know the value of the optional card before each player chooses whether or not to make the alive wager. The alive wager is resolved based on the blackjack hand, not the poker hand, even though the optional card can be used to improve both the player's blackjack hand and poker hand.

From operation 118 (or operation 116 if the player did not make the alive wager), the method proceeds to operation 120, wherein the optional ("dead or alive") card is revealed. This is done after all players have had the chance to make the alive wager. (the alive wager cannot be made once the optional card is revealed).

From operation 120, the method proceeds to operation 122, wherein all of the remaining cards that are face down are revealed.

From operation 122, the method proceeds to operation 124 which determines who wins the blackjack game, the player or the dealer. The player's blackjack hand is formed by using two cards, either the player's two hole cards, or (if the player made the "alive" wager) one of the player's hole cards and the optional card (the remaining player's hole card was discarded). The dealer's blackjack hand is formed using 2 or 3 out of the initial three cards that were dealt to the dealer (in operation 102). The dealer will pick the best 2 cards (or all 3) in order to make the best blackjack hand, that is the hand with the point total closest or equal to 21 without going over 21.

If a point total of the player's blackjack hand is closer to 21 than a point total of the dealer's blackjack hand, then the player wins the blackjack game (e.g., the player's blackjack hand beats the dealer's blackjack hand). If the point total of the dealer's blackjack hand is closer to 21 than the point total of the player's blackjack hand, then the dealer wins the blackjack game (e.g., the dealer's blackjack hand beats the player's blackjack hand). If the point total of the player's blackjack hand is equal to the point total of the dealer's blackjack hand, then the blackjack game results in a push.

Unlike regular blackjack, in the blackjack game used herein, the player and the dealer can have final point totals under 17. The highest point total that does not exceed 21 wins. Thus, for example, if the dealer has a point total of 15 and the player has a point total of 12, the dealer wins the blackjack game. Cards can have their standard point value (e.g., aces can count as one or eleven (whichever is better), 2-10 count as their face value, and jacks, queens, and kings all count as 10).

From operation 124, the method proceeds to operation 126, which determines who wins the poker game, the player or the dealer. The dealer's poker hand is determined by the best five card poker hand made out of all of the available cards to the dealer. The cards available to the dealer are all of the dealer's initial cards (dealt in operation 102) as well as all of the community cards. However, the dealer cannot use the optional ("dead or alive") card. Since (in one embodiment), there are three dealer initial cards (1 face up card and 2 dealer hole cards) and four community cards, the dealer has 7 cards in order to choose his or her best 5 card hand. The dealer's 5 card poker hand is a mechanical decision which chooses the best 5 card poker hand out of the available cards to the dealer. Thus, the dealer's poker hand can be formed using one of (any 2 of 3 initial dealer cards+3 community cards); (any 1 of 3 initial dealer cards+4 community cards); (0 initial dealer cards+5 community cards). Once again, the community cards available to the dealer do not include the "optional" or "dead or alive" card.

The player's poker hand is determined by the best five card poker hand made out of all of the available cards to the player. The cards available to the player are all player hole cards that were not discarded (this will be 1 or 2), the community cards (4 in one embodiment), and possibly the optional card (if the player made the alive wager). Thus, there will be 6 cards available to the player in order to make the best 5 card poker hand. The player's 5 card poker hand is a mechanical decision which chooses the best 5 card poker hand out of the available cards to the player. Thus, the player's poker hand can be formed using one of (2 player hole cards+3 community cards); (1 player hole card+4 community cards); (0 hole card+5 community cards). The player hole cards are the cards initial dealt to the player in operation 102. The "dead or alive" card is considered to be one of the community cards and can be used by the player if the player made the alive wager, but cannot be used by the player if the player did not make the alive wager.

Standard poker ranks can be used when ranking poker hands. Table I below illustrates a list of standard poker ranks, in the order from highest ranking (best) on top to the lowest ranking (worst) on bottom. Equal ranks in Table I can be resolved according to standard poker rules. For example, typically hands with higher cards rank higher than hands with lower cards. For example, three kings will rank higher than three 3's. In a further embodiment, non-standard poker ranks can be used as well.

TABLE I

| |
|---|
| Royal Flush |
| Straight Flush |
| Four of a Kind |
| Full House |
| Flush |

TABLE I-continued

| |
|---|
| Straight |
| Three of a Kind |
| Two Pairs |
| Pair |
| High Card |

Once the player's best poker hand (the player's hand) and the dealer's best poker hand (the dealer's hand) are determined, they are compared. If the player's poker hand ranks higher than (beats) the dealer's hand using standard poker rankings, then the player wins the poker game. If the dealer's poker hand ranks higher than (beats) the player's hand using standard poker rankings, then the dealer wins the poker game. If the player's poker hand and the dealer's poker hand tie (very unlikely), then the result of the poker game is a push.

From operation 126, all live wagers on the table can now be resolved. There are seven wagers described herein that are resolved individually. They are resolved as follows.

The blackjack ante wager (placed in operation 100) pays the player 3:2 if the player wins the blackjack game with a hand total of exactly 21. The blackjack ante wager pays 1:1 if the player wins the blackjack game. If the blackjack game ties, then the blackjack ante wager pushes (neither wins nor loses). If the dealer wins the blackjack game, then the player loses the blackjack ante wager. Of course, other payouts can be used as well.

The poker ante wager is won by the player if the player's poker hand ranks higher than the dealer's poker hand. If the player's poker hand rank ties the dealer's poker hand rank, then the poker ante wager pushes. If the dealer's poker hand rank is greater than the player's poker hand rank then the player loses the poker ante wager. If the player wins the poker ante, the player can also be eligible for a bonus payout if the player's poker rank is a predetermined hand. Table II illustrates possible bonus payouts based on the player's poker hand for a winning player poker hand. Thus for example, if the player wins the poker game and the player has a full house then the player wins a 4:1 payout on the poker ante wager. If the player wins the poker game but the player only has a pair, then the player does not get a bonus payout other than winning a 1:1 (even money) payout on the poker ante wager. It is noted that these payouts are merely examples, and other payout tables can be used as well.

TABLE II

| Hand | payout |
|---|---|
| Royal flush | 250:1 |
| Straight flush | 50:1 |
| Four of a kind | 10:1 |
| Full house | 4:1 |
| Flush | 3:1 |
| Straight | 2:1 |
| Three of a kind | 3:2 |
| Any other win | 1:1 |

The first wager (wager #1) placed in operation 105 pays the player a 2:1 payout if the player wins both the blackjack game and the poker game. If the player wins one and ties the other (or ties both), then the first wager pushes. Otherwise, the player loses the first wager. In other words, if the player loses either the blackjack game or the poker game the player loses the first wager.

The second wager (wager #2) placed in operation 109 pays the player 1:1 if the player wins the poker game. The second wager pushes if the player ties the dealer on the poker game.

Otherwise the player loses the second wager (if the dealer wins the poker game). The second wager does not involve the blackjack game.

The third wager (wager #3) placed in operation 114 pays the player 1:1 if the player wins the poker game. The third wager pushes if the player ties the dealer on the poker game. Otherwise, the player loses the second wager (if the dealer wins the poker game). The third wager, like the second wager, does not involve the blackjack game.

The alive wager pays the player 1:1 if the player wins the blackjack game, pushes if the player ties the dealer in the blackjack game, and otherwise loses (if the dealer wins the blackjack game).

The progressive jackpot bet pays 100% of the jackpot pool if the player has a blackjack hand of 21 and a poker hand rank of royal flush (although the player does not necessarily need to win either or both of these hands to win the progressive). The progressive jackpot bet pays 90% of the jackpot pool if the player has a royal flush (although the player does not necessarily need to win the poker game). The progressive jackpot bet pays 10% of the jackpot pool if the player has a straight flush (although the player does not necessarily need to win the poker game). If there is more than one player at a time that has a jackpot hand, only the player with the best hand wins. If two or more players have jackpot hands that tie, then the appropriate share of the progressive jackpot pool is divided evenly between the tying players who qualified.

It is noted that the operations in FIG. 1 can be performed in any sensible order. For example, operations 124 and 126 can be reversed. Furthermore, it is not critical how the cards in the game is dealt, for example operations 120 and 122 can be combined or reversed as well. It is further noted that other numbers of cards can be used than the ones described herein (e.g., the second set of community cards can have 1, 3, 4, 5 cards instead of 2). It is also noted that all bets described herein can be optional and are not required to be offered. For example, the second wager need not even be offered. In a further embodiment the players blackjack hand can be formed using one or more of the community cards and the dealers blackjack hand can be formed using one or more of the community cards.

Figure 2:
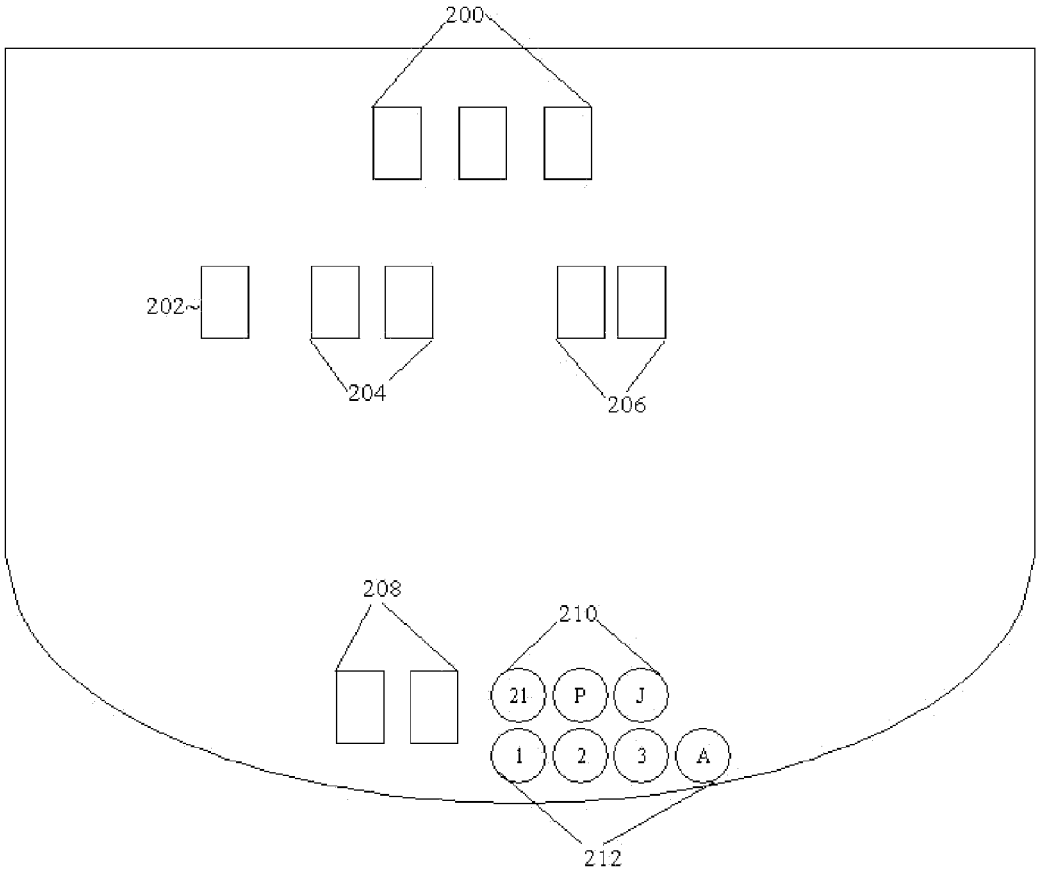
FIG. 2 is drawing illustrating an example of a gaming table layout, according to an embodiment.

FIG. 2 is a drawing illustrating an example of a gaming table layout, according to an embodiment. The game can be implemented on a physical gaming table (as known in the art) with a felt layout specific for the game described herein. Physical chips can be used to place the wagers which can be moved to appropriate places on the felt.

The dealer's initial cards 200 are dealt in operation 102 (one face up, two hole cards face down). It does not matter which card is the face up card. The player's hole cards 208 are also dealt in operation 102. The "dead or alive" or "optional" card 202 is dealt in operation 106 and remains face down (and unknown to the players) until the players have placed (or declined to place) the alive wager (in operation 118). Community cards 204 are also dealt in operation 106. A second set of community cards 206 is dealt in operation 110. The optional card 202 can also be considered a community card, although only the player is permitted this card (but not the dealer).

A first row of betting circles 210 represents wagers that can be made before the game begins. A blackjack ante betting circle 21 is used to place the blackjack ante (in operation 100). A poker betting circle P is used to place the poker ante (in operation 100). A progressive jackpot betting circle J is used to place the progressive jackpot wager (typically $1) in operation 100. A second row of betting circles 212 is used to place wagers during the game. A first wager betting circle 1 is used to place the first wager (in operation 105). A second wager betting circle 2 is used to place the second wager (in operation 109). A third wager betting circle 3 is used to place the third wager (in operation 114). An alive wager betting circle A is used to place the alive wager (in operation 118).

Of course, the physical locations of these betting circles can vary. Only one player is illustrated in FIG. 2 for simplicity, but typically such a table can accommodate numerous simultaneous players (e.g., 6-8) who each have their own respective set of betting circles like the ones illustrated herein.

An example of the game will now be presented to illustrate the game. Joe walks up to the table and places a $5 blackjack ante wager and a $5 poker ante wager. Joe declines to make the progressive jackpot wager. The dealer deals the dealer an upcard of 10 of hearts and two dealer's hole cards (face down). The dealer also deals Joe two hole cards of 2 of clubs and 5 of diamonds. Joe now has to decide whether to place the first wager or not. Joe decides to place the first wager and places a first wager of $5. The dealer now deals the first set of community cards, which is a face down dead or alive (or "optional") card and two face up community cards of 4 spades/9 hearts. Joe now has to decide whether or not to place the second wager or not. Joe declines to place the second wager. The dealer now deals a second set of community cards which are queen of spades/5 of hearts. Joe decides to make the third wager of $5. Joe now also has to decide whether or not to place the alive wager and use the "dead or alive" card. Joe decides to place the alive wager ($5) and decides to discard the 2 of clubs. The 2 of clubs is now discarded and is taken by the dealer and is no longer part of the game. Now the dealer reveals the dead or alive card, which is revealed to be a 7 of spades. The dealer also reveals the dealer's two hole cards to be a 10 of clubs/7 of hearts.

Joe's blackjack hand is formed using the dead or alive card (7 of spades) and Joe's remaining (non-discarded) hole card (5 of diamonds), for a point total of 12. The dealer's blackjack hand is formed using the best 2 or 3 card hand from the dealer's cards (10 of hearts/10 of clubs/7 of hearts), the best blackjack hand being the 10 of hearts/10 of clubs for a point total of 20. Thus, the dealer has won the blackjack game.

Joe's poker hand is formed using the dead or alive card (7 of spades), Joe's remaining (non-discarded) hole card (5 of diamonds) and the four community cards (4 of spades/9 of hearts/queen of spades/5 of hearts). The best 5 card poker hand out of these six cards would be 5 of diamonds/5 of hearts/queen of spades/9 of hearts/7 of spades, for a pair of 5's. The dealer's poker hand is formed using the dealer's cards (10 of hearts/10 of clubs/7 of hearts) and the four community cards (4 of spades/9 of hearts/queen of spades/5 of hearts), but not the dead or alive card. The dealer's best 5 card hand out of these cards would be 10 of hearts/10 of clubs/queen of spades/9 of hearts/7 of hearts, for a pair of 10's.

Thus, since the dealer has the better blackjack hand, the player loses the blackjack ante wager, the first wager, and the alive wager. If Joe would have had the better blackjack hand, then Joe would have won the ante wager, the first wager (if Joe also had the better poker hand), and the alive wager.

Since the dealer has the better poker hand, the player loses the poker ante, and the third wager. Since Joe did not make the second wager of course he cannot lose the second wager. If Joe would have had the better poker hand, then Joe would have won the poker ante, the first wager (If Joe also had the better blackjack hand) and the third wager. Thus, in this example, Joe has lost all of the four bets he has placed on the table.

Figure 3:
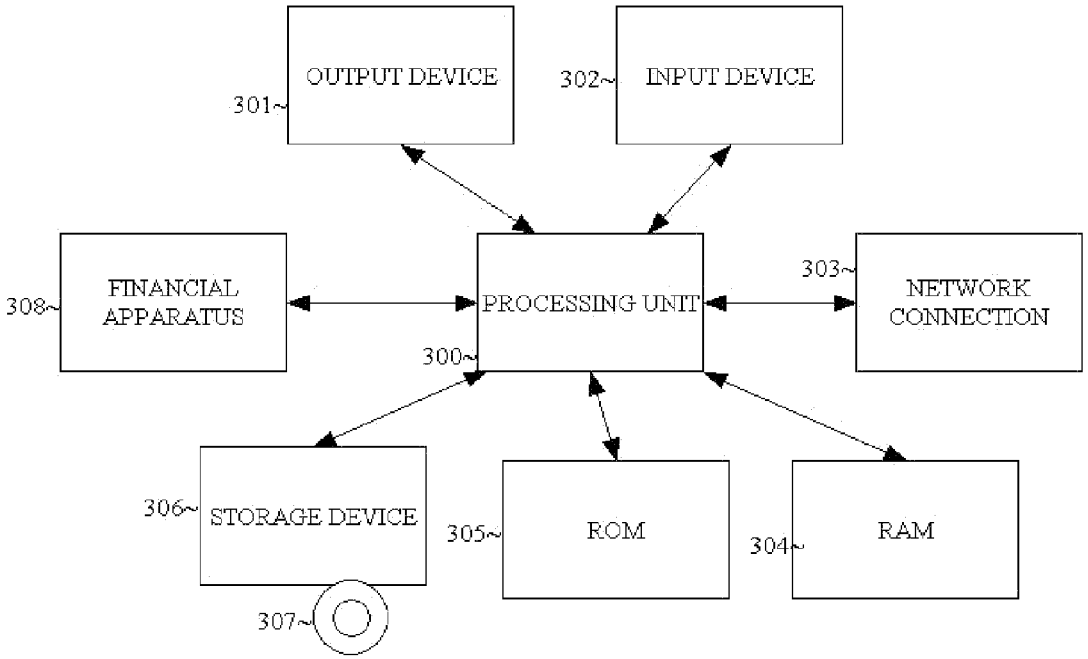
FIG. 3 is a block diagram illustrating exemplary hardware that can implement an electronic version implementing methods described herein, according to an embodiment.

FIG. 3 is a block diagram illustrating exemplary hardware that can implement an electronic version implementing methods described herein, according to an embodiment. In addition to being played in a physical casino table, the methods described herein can also be played on an electronic gaming device or on a computer using the Internet.

A processing unit 300 (such as a microprocessor and any associated components) is connected to an output device 301 (such as an LCD monitor, touch screen, CRT, etc.) and an input device 302 (e.g., buttons, a touch screen, a keyboard, mouse, etc.) The output device 301 can output a game layout with cards, for instance that illustrated in FIG. 2. The processing unit 300 can also be connected to a network connection 303, which can connect the electronic gaming device to a computer communications network such as the Internet, a LAN, WAN, etc. The processing unit 300 is also connected to a RAM 304 and a ROM 305. The processing unit 300 is also connected to a storage device 306 which can be a DVD-drive, CD-ROM, flash memory, etc. A computer readable storage medium 307 can store a program which can control the electronic device to perform any of the methods described herein. The processing unit 300 can also be connected to a financial apparatus 308 which can receive cash and convert the received cash into playable credits for use by the player when playing the electronic device. When the player decides to cash out any remaining credits, the financial apparatus 308 can issue coins or a cashless ticket (voucher) for the remaining credits which is redeemable by the player.

It is noted that the methods described herein can be played using any number (e.g., 1-8 or more) of decks (physical or virtual). Standard decks of 52 cards can be used, as well as other kinds of decks, such as Spanish decks, decks with wild cards, etc. The operations described herein can be performed in any sensible order. Cards can be given their standard point values as known in the art (e.g., 2-10 have their face value, jack, queen, and king, have a point value of 10, and ace has a point value of 1 or eleven). Physical chips can be used to represent wagers, which are directly redeemable for cash.

The descriptions provided herein also include any hardware and/or software known in the art and needed to implement the operations described herein. Further, all methods described herein can be programmed on a digital computer and stored on any type of computer readable storage medium.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a blackjack game, the method comprising:

executing on an electronic processing unit instructions that perform:

providing a virtual deck(s) of cards;

receiving a blackjack ante wager from a player and a poker ante wager;

dealing player's cards, dealer's cards, an optional card, and community cards;

offering the player an option to make an additional wager to discard one of the player's cards and activate the optional card and receiving the player's acceptance or denial of the option;

determining the player's blackjack hand using the player's cards and the optional card if activated;

determining the players poker hand using the player's cards, the community cards, and the optional card if activated;

determining the dealer's blackjack hand and the dealer's poker hand;

resolving the blackjack ante wager based on a relationship between the player's blackjack hand and the dealer's blackjack hand; and resolving the poker ante wager based on a relationship between the player's poker hand and the dealer's poker hand.

2. The method as recited in claim 1, wherein the dealer's cards comprise one card dealt face up and two cards dealt face down.

3. The method as recited in claim 1, wherein the additional wager must be equal in amount to the blackjack ante wager.

4. The method as recited in claim 1, wherein the blackjack ante wager must be equal in amount to the poker ante wager.

5. The method as recited in claim 1, further comprising offering the player to place a first wager before the community cards are revealed, the first wager being resolved based on relationships between the player's blackjack hand and the dealer's blackjack hand and the player's poker hand and the dealer's poker hand.

6. The method as recited in claim 5, wherein if the player's blackjack hand beats the dealer's blackjack hand and if the player's poker hand beats the dealer's poker hand then the player wins a payout on the first wager.

7. The method as recited in claim 6, wherein if the dealer's blackjack hand beats the player's blackjack hand or if the dealer's poker hand beats the player's poker hand then the player loses the first wager.

8. The method as recited in claim 1, further comprising offering the player to place a second wager after some community cards are revealed, but before all community cards are revealed, the second wager being resolved based on a relationship between the player's poker hand and the dealer's poker hand.

9. The method as recited in claim 1, further comprising offering the player to place a third wager after all community cards are revealed, but before all dealers cards are revealed, the third wager being resolved based on a relationship between the player's poker hand and the dealer's poker hand.

10. The method as recited in claim 1, wherein the dealer's poker hand and the dealer's blackjack hand are not permitted to incorporate the optional card.

11. The method as recited in claim 1, wherein if the player's blackjack hand beats the dealer's blackjack hand then the player wins a payout on the additional wager, otherwise the player does not win a payout on the additional wager.

12. A method to play a blackjack game, the method comprising:

executing on an electronic processing unit instructions that perform:

providing a virtual deck(s) of cards;

dealing player's cards, dealer's cards, an optional card, and community cards;

determining the player's blackjack hand using the player's cards;

determining the players poker hand using the player's cards and the community cards;

determining the dealer's blackjack hand using the dealer's cards and the dealer's poker hand using the dealer's cards; and resolving a first wager placed by a player, wherein if both the player's blackjack hand beats the dealer's blackjack hand and if the player's poker hand beats the dealer's poker hand then the player wins a payout on the first wager, otherwise the player does not win a payout on the first wager.

13. The method as recited in claim 12, wherein if the dealer's blackjack hand beats the player's blackjack hand of if the dealer's poker hand beats the player's poker hand then the player loses the first wager.

14. The method as recited in claim 12, wherein the dealer's cards comprise one card dealt face up and two cards dealt face down.

15. An apparatus to play a poker game, the apparatus comprising:

a processing unit connected to an input device and an output device, the processing unit configured to perform:

providing a virtual deck(s) of cards;

receiving a blackjack ante wager from a player and a poker ante wager;

dealing player's cards, dealer's cards, an optional card, and community cards;

offering the player an option to make an additional wager to discard one of the player's cards and activate the optional card and receiving the player's acceptance or denial of the option;

determining the player's blackjack hand using the player's card(s) and the optional card if activated;

determining the players poker hand using the player's card(s), the community cards, and the optional card if activated;

determining the dealer's blackjack hand and the dealer's poker hand;

resolving the blackjack ante wager based on a relationship between the player's blackjack hand and the dealer's blackjack hand; and resolving the poker ante wager based on a relationship between the player's poker hand and the dealer's poker hand.

16. The apparatus as recited in claim 15, wherein the dealer's cards comprise one card dealt face up and two cards dealt face down.

17. The apparatus as recited in claim 15, wherein the additional wager must be equal in amount to the blackjack ante wager.

18. The apparatus as recited in claim 15, wherein the blackjack ante wager must be equal in amount to the poker ante wager.

19. The apparatus as recited in claim 15, wherein the processing unit is further configured to performs: offering the player to place a first wager before the community cards are revealed, the first wager being resolved based on relationships between the player's blackjack hand and the dealer's blackjack hand and the player's poker hand and the dealer's poker hand.

20. The apparatus as recited in claim 19, wherein the processing unit is further configured to perform: if the player's blackjack hand beats the dealer's blackjack hand and if the player's poker hand beats the dealer's poker hand then the player wins a payout on the first wager.

* * * * *